US008125398B1

(12) United States Patent
Paulsen

(10) Patent No.: US 8,125,398 B1
(45) Date of Patent: Feb. 28, 2012

(54) CIRCULARLY-POLARIZED EDGE SLOT ANTENNA

(75) Inventor: Lee M. Paulsen, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 460 days.

(21) Appl. No.: 12/381,743

(22) Filed: Mar. 16, 2009

(51) Int. Cl.
*H01Q 1/28* (2006.01)
*F41G 7/00* (2006.01)

(52) U.S. Cl. ..... 343/705; 343/767; 102/214; 244/3.14

(58) Field of Classification Search ..... 343/705, 343/708, 770, 767, 725; 102/211, 214, 293; 244/3.14, 3.21
See application file for complete search history.

(56) References Cited

U.S. PATENT DOCUMENTS 6,098,547 A * 8/2000 West ..... 102/214
6,307,514 B1 * 10/2001 West ..... 343/705
6,473,041 B2 * 10/2002 Koch et al. ..... 343/700 MS

* cited by examiner

*Primary Examiner* — Tan Ho
(74) *Attorney, Agent, or Firm* — Donna P. Suchy; Daniel M. Barbieri

(57) ABSTRACT

A multi-element anti-jamming (A/J) antenna array is disclosed. The multi-element anti-jamming (A/J) array may include a circularly-polarized edge slot antenna and a dielectric resonator antenna. The circularly-polarized edge slot antenna and the dielectric resonator antenna are configured for implementation within an artillery shell, munition, or the like. The circularly-polarized edge slot antenna may be a gun-hard, embedded GPS antenna having an on-axis phase center. Further, the circularly-polarized edge slot antenna may have a forward-looking radiation pattern.

20 Claims, 5 Drawing Sheets

CIRCULARLY-POLARIZED EDGE SLOT ANTENNA

FIELD OF THE INVENTION

The present invention relates to the field of advanced sensors and more particularly to a gun-hard, embedded edge slot antenna with a forward-looking, circularly-polarized gain pattern.

BACKGROUND OF THE INVENTION

Artillery shells typically utilize a fuse installed at the leading end of the shell. The fuse may be a mechanical or electronic device designed to control the detonation of the explosive charge (ex-payload) of the shell. A number of currently available artillery shell fuses include electronics and telemetry systems for promoting improved accuracy and detonation control. Electronic circuits disposed in the fuse remain in radio-frequency contact with a ground station after launch of the shell for coordinating the trajectory of the shell and making course corrections as necessary. Further, the artillery fuse may operate in conjunction with a satellite-based positioning system, such as the NAVSTAR global positioning systems (GPS), maintained and operated by the United States government, for accurately determining the coordinates of the shell as it travels along its trajectory and reaches the point of impact, and for correcting the trajectories of subsequently fired munitions. GPS may also be used as a positional reference to deploy retractable airfoil flaps of an artillery shell, from a previous free fall state, to more accurately control the downward descent of the artillery shell towards the target.

An artillery shell fuse having telemetry and positioning system electronics requires an antenna suitable for the application and environment to which an artillery shell is subject. A number of currently available antenna systems for artillery shells may not provide a desired level of performance.

Thus, it would be desirable to have an antenna system for artillery shells which addresses the problems associated with current solutions.

SUMMARY OF THE INVENTION

Accordingly an embodiment of the present invention is directed to an artillery shell, including: a payload; a guidance system including a radio receiver; and a multi-element antenna array communicatively coupled to the radio receiver, the antenna array including a first antenna and a second antenna, wherein the first antenna is a circularly-polarized edge slot antenna and the second antenna is a dielectric resonator antenna.

A further embodiment of the present invention is directed to a multi-element anti-jamming (A/J) antenna array, including: a circularly-polarized edge slot antenna; and a dielectric resonator antenna, wherein the circularly-polarized edge slot antenna and the dielectric resonator antenna are configured for implementation within at least one of an artillery shell and a munition.

An additional embodiment of the present invention is directed to an edge slot antenna, including: a first substrate; a second substrate; and a ground surface configured between the first substrate and the second substrate, said ground surface providing a boundary between the first substrate and the second substrate, wherein the edge slot antenna forms a first aperture for receiving a first feed and a second aperture for receiving a second feed, said feeds being offset feeds, said edge slot antenna being circularly-polarized and configured for implementation within at least one of an artillery shell and a munition.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
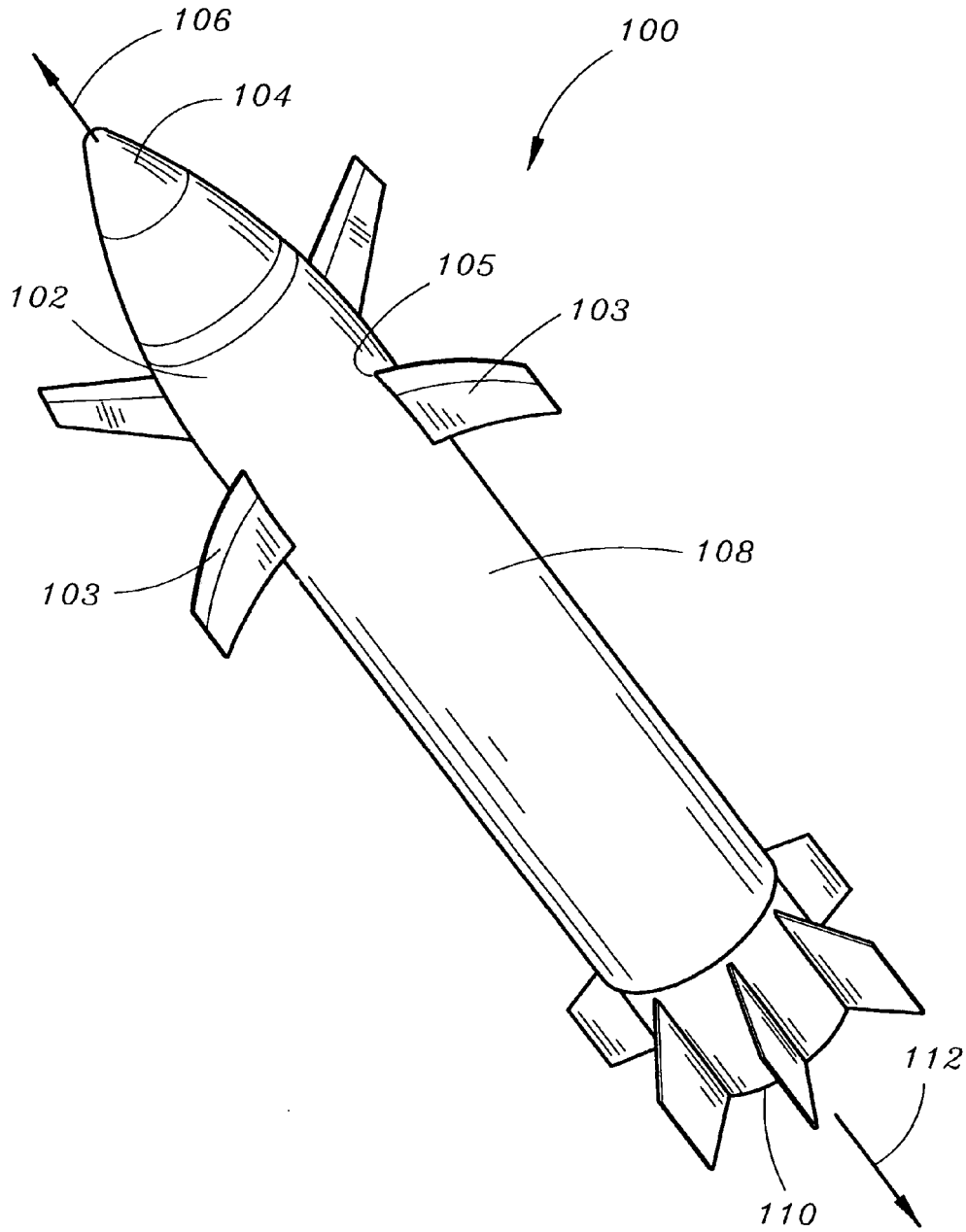
FIG. 1 is an illustration of an artillery shell in accordance with an exemplary embodiment of the present invention.

Reference will now be made in detail to the presently preferred embodiments of the invention, examples of which are illustrated in the accompanying drawings.

An artillery shell fuse having telemetry and positioning system electronics requires an antenna suitable for the application and environment to which an artillery shell is subject. A number of currently available antennas have radiation patterns which are omni-directional in orthogonal directions about the shell trajectory and thus, may be capable of being jammed from terrestrial positions. Other currently available antennas may be subject to performance degradation effects including carrier-phase roll up, phase carrier wrap, and roll-ripple due to antenna asymmetry. For example, side-mounted patch antennas (ex.—side-mounted L1 patch antennas) may be implemented as artillery shell fuze GPS antennas. However, said side-mounted patch antennas may have very poor gain (as measured via anechoic chamber) and may exhibit unacceptable gain and phase modulation effects as the shell spins. For instance, when implementing said side-mounted patch antennas, because GPS integrators may be working slower than the shell is rolling, complex voltage gain may need to be integrated over the entire roll dimension to calculate the gain actually seen/detected by the GPS receiver. This may result in very significant reductions in gain, thereby making fast initial acquisitions extremely difficult/impossible.

An antenna such as a Dielectric Resonator Antenna (DRA), such as a Dielectric Resonator Antenna developed by Rockwell Collins, Inc., may be mounted in the nose of an artillery shell (ex.—may be a nose-mounted antenna). Because the DRA sits on the nose of the shell, the pattern/radiation pattern of the DRA may be symmetric throughout the roll axis. Thus, the DRA does not suffer a roll-induced gain reduction and has a 10+Decibels isotropic (dBi) more coherent gain than a side-mounted patch antenna. Further, the DRA may be a Circularly Polarized DRA (CP DRA).

Further, a linearly-polarized edge slot antenna/linearly-polarized edge slot antenna array may be implemented in an artillery shell. For example, the linearly-polarized edge slot antenna/linearly-polarized edge slot array may be/may include edge slot antennas/edge slot radiators as described in one or more of the following: U.S. patent application Ser. No. 11/900,123 (pending) entitled: "GPS Munitions/Artillery Anti-Jamming Array With Multi-Band Capability", filed Sep. 10, 2007; U.S. patent application Ser. No. 11/821,824 (pending) entitled: "Munitions/Artillery Shell GPS Multi-Edge Slot Anti-Jamming Array", filed Jun. 26, 2007; U.S. Pat. No. 6,307,514 entitled: "Method and System for Guiding an Artillery Shell", and U.S. Pat. No. 6,098,547 entitled: "Artillery Fuse Circumferential Slot Antenna for Positioning and Telemetry", each of which are herein incorporated by reference in their entireties. For instance, a dual-band edge slot antenna may be embedded in a munition/artillery shell (ex.—said shell may have a radome). Further, the linearty-polarized edge slot antenna may have a single, centered feed point which produces the linear polarization (ex.—may be a center-fed edge slot antenna). The linearly-polarized edge slot antenna may have an on-axis phase center, thus, it may not suffer from roll-induced gain reduction or phase modulation. However, said linearly-polarized edge slot antenna has a classic monopole radiation pattern and is linearly-polarized, thereby resulting in a lower overall gain than the CP DRA described above. Also, because the gain pattern of the linearly-polarized edge slot antenna does not overlap well with the DRA/CP DRA, it may not be an optimal choice to pair with the DRA/CP DRA for Anti-Jamming (AJ).

An antenna implemented in munitions/artillery shells should be able to survive the extreme acceleration and high rotational velocities typical of gun-launched projectiles. Further, the radiation pattern of the antenna telemetry should exhibit relatively high gain in the aft direction (i.e., the direction opposite the direction of travel of the shell), while the radiation pattern for the GPS system should be minimal in the direction of travel of the shell to minimize or prevent jamming from the vicinity of the target area of the shell. Such an antenna should be of sufficiently reduced size so as not to occupy a large amount of space within the interior of the fuse, and is preferably designed for operation with L-band and S-band signals. ("L" being the letter designation for microwave signals in the frequency range from 1 to 2 GHz; "S" being the letter designation for microwave signals in the frequency range from 2 to 4 GHz).

Referring now to FIG. 1, an artillery shell in accordance with the present invention is shown. The artillery shell 100 or similar munition is typically launched or fired from a cannon, mortar, or similar type of gun (not shown). A fuse 104 is disposed at the nose 102 of the artillery shell 100 and is typically physically contiguous with the body 108 of the shell. The fuse 104 may be a mechanical or electronic device utilized for detonating an explosive charge, such as the charge or payload of the artillery shell 100 or similar munition. The artillery shell 100, when launched or otherwise projected, generally travels in a forward direction 106 toward the vicinity of a target. During flight, the rear 110 of the artillery shell 100 generally points in the aft direction 112 toward the vicinity of origin of the shell (ex—toward the gun from which the shell was launched). In exemplary embodiments, during flight, retractable airfoil flaps 103 or any like selectively deployable airfoil mechanism may be deployed to change the trajectory of the shell 100. Retractable airfoil flaps 103 are shown as extending from slots 105.

Figure 2A:
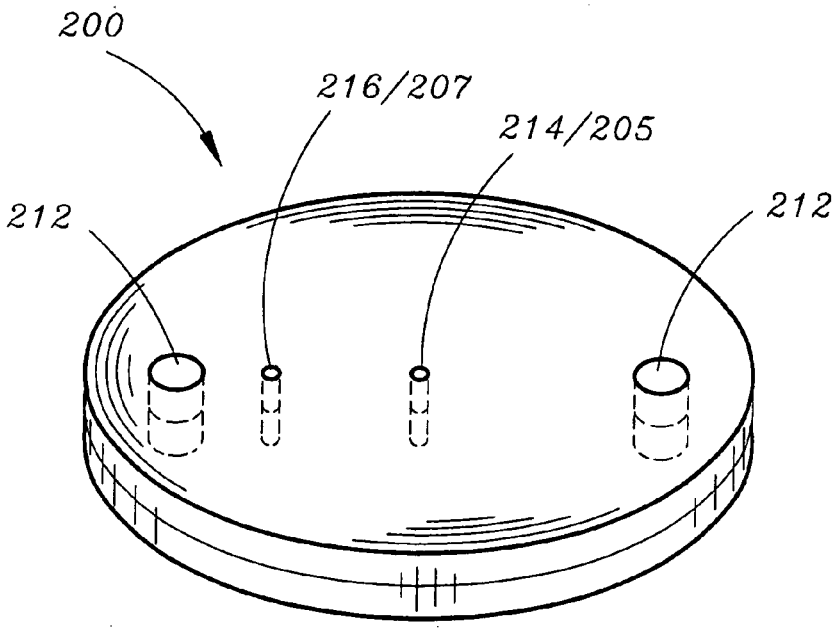
FIG. 2A is a perspective view of a circularly-polarized edge slot antenna in accordance with an exemplary embodiment of the present invention.
Figure 2B:
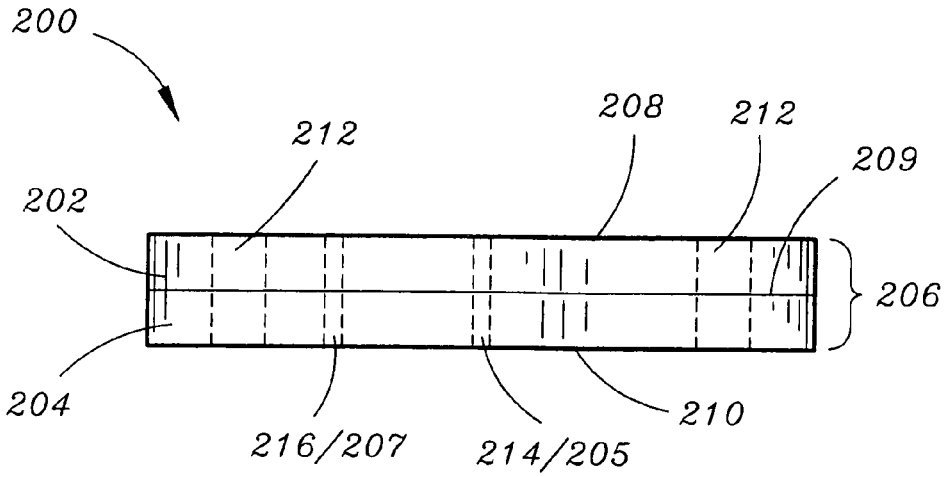
FIG. 2B is a view of a circularly-polarized edge slot antenna in accordance with an exemplary embodiment of the present invention.

Referring generally to FIGS. 2A and 2B, an antenna 200 in accordance with an exemplary embodiment of the present invention is shown. In a current embodiment of the present invention, the antenna 200 is a circularly-polarized edge slot radiator/edge slot antenna/radial transmission line antenna/edge-slot antenna. For example, the circularly-polarized edge slot antenna 200 may be a multi-band edge slot antenna, such as a dual band edge slot antenna having a first substrate 202 (ex.—an L1 band/substrate 202), which may support a first frequency (ex.—an L1 GPS frequency (ex.—1.575 GHz)) and a second substrate 204 (ex.—an L2 band/substrate 204), which may support a second frequency (ex.—an L2 GPS frequency (ex.—1.227 GHz)).

In additional embodiments, the multi-band edge slot antenna 200 may support other L-band frequencies, such as L3, L5 or the like. In further embodiments, the multi-band edge slot antenna 200 may support S-band frequencies (such as for telemetry and control) and C-band frequencies (such as for Height of Burst (HOB)-related direction finding). In exemplary embodiments, the L1 band 202 and the L2 band 204 may be disc-shaped and have straight edges (as shown in FIGS. 2A and 2B). In alternative embodiments, the L1 band 202 and the L2 band 204 may be slanted edge discs. In further embodiments, the L1 band 202 and the L2 band 204 may be of differing size and/or shape relative to one another. The edge slot antenna 200 substrates (202, 204) may be disk-shaped, dielectric substrates (202, 204), which may be formed of Teflon-fiber-glass or similar RF dielectric material.

In further embodiments, the substrates 202, 204, (collectively shown as a substrate assembly 206) may be metal-plated (ex—copper-plated), such as on an upper surface (ex—upper edge slot ground) 208 of the substrate assembly 206, a middle surface 209 of the substrate assembly 206, and a lower surface (ex—lower edge slot ground) 210 of the substrate assembly 206. Further, the first substrate 202 (ex—GPS L1) and the second substrate 204 (ex—GPS L2) are connected via/separated by the middle surface 209, said middle surface forming a boundary/boundary surface for individual radiating elements of the edge slot antenna 200. Additionally, the antenna 200 may be configured with one or more shunt inductive posts 212, such as fixed shunt L inductive tuning posts. The posts 212 may be tunable by means of embedded tuning varactor diodes, PIN diode switches, or the like. The posts 212 may allow for adjusting of roll pattern symmetry and may further be utilized to facilitate input impedance match. In exemplary embodiments, the posts 212 may be hollow, metallic posts configured for routing bias and control signals through the antenna 200.

In additional embodiments, the substrate 206 may further form/may have a first aperture 205, such as a centrally located aperture formed therethrough, for receiving a first feed/probe feed/input pin/pin probe 214. For example, the first probe feed/pin probe 214 may be an extension of a center conductor of a first L1/L2 coaxial feed for providing a first common L1/L2 input. The substrate 206 may further form/may have a second aperture 207, such as an offset/non-centrally located aperture formed therethrough, for receiving a second feed/probe feed/input pin/pin probe 216. For instance, the second probe feed/pin probe 216 may be an extension of a conductor of a second L1/L2 coaxial feed for providing a second common L1/L2 input. The antenna 200 may be fed via the first probe feed/input pin 214 and the second probe feed/input pin 216, such that each of the radiating elements of the antenna are simultaneously excited in-phase. Further, the inputs 214, 216 of the antenna 200 may be impedance-matched to a characteristic impedance(s) of an RF feed(s) or an RF transceiver assembly via an additional layer of RF microstrip or stripline circuit board (ex—an RF match board), such as via numerous known techniques. For example, the RF match board may be integrated into the RF transceiver assembly.

Figure 3B:
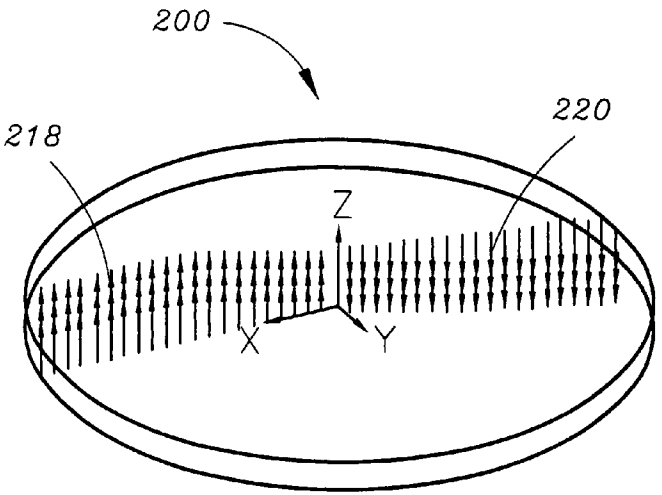
FIG. 3B is a view of a circularly-polarized edge slot antenna wherein said view illustrates cavity modes being driven within the circularly-polarized edge slot antenna.

In exemplary embodiments, the circularly-polarized edge slot antenna 200/a cavity formed within or formed by the circularly-polarized edge slot antenna 200 may be fed off-center (such as via the feeds/offset probe feeds 214, 216). When fed-off center, the circularly-polarized edge slot antenna 200 may be designed such that, one or more patch-like cavity modes 218, 220 (ex.—$TM_{110}$ cavity modes) may be formed within/may be driven within the dielectric region/dielectric substrates 202, 204 of the antenna 200 (as shown in FIG. 3B). In further embodiments, the cavity mode(s) 218, 220 (ex.—$TM_{110}$ modes) may present fields to a radiation aperture of the antenna 200 such that said cavity mode(s) may produce/may cause the circularly-polarized edge slot antenna 200 to provide a forward-looking radiation pattern. In a current embodiment of the present invention, two orthogonal cavity modes 218, 220 (ex.—$TM_{110}$ patch modes) may be driven in quadrature by separate feed probes (ex.—feed probes 214, 216), thereby resulting in/causing the antenna 200 to provide a circularly-polarized radiation pattern. The circularly-polarized radiation pattern provided by the antenna 200 may be predominantly forward-looking, may have good gain, and may be very different from radiation patterns provided by linearly-polarized edge slot antennas. In exemplary embodiments of the present invention, the circularly-polarized edge slot antenna 200 may offer a full hemisphere of gain coverage (ex.—zenith to horizon) above the −5 dBic level.

Figure 3A:
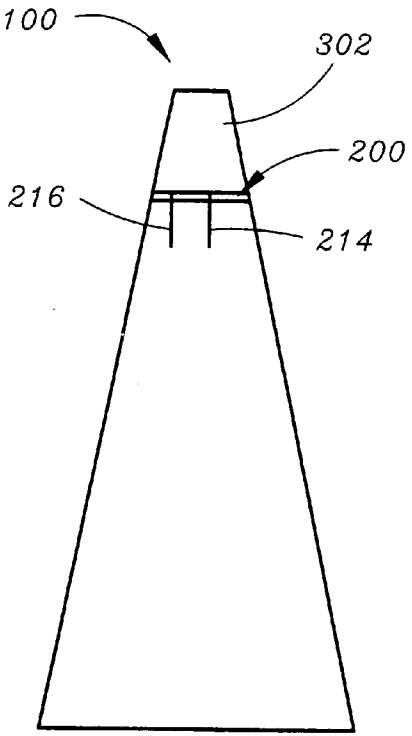
FIG. 3A is a view of an artillery shell implementing a circularly-polarized edge slot antenna in accordance with an exemplary embodiment of the present invention.

In exemplary embodiments, the circularly-polarized edge slot antenna 200 may be a conformal antenna (sized so as not to perturb general shape of the projectile) which may be implemented within/embedded within the artillery shell 100 (such as being embedded in a radome 302 of the artillery shell 100 as shown in FIG. 3A) and may be configured for receiving satellite-based navigation system signals (such as GPS signals, Global Navigation Satellite System (GLONASS) signals, or the like) via electronics (ex—DIGNU/IGS (Deeply Integrated Guidance Navigation Unit/Inertial Guidance System)) contained within the artillery shell 100 for promoting course or trajectory correction functionality for the artillery shell (as will be described further below). Utilizing an embedded edge slot antenna 200 (as opposed to a side-mounted patch antenna) may ensure an on-axis phase center, thereby minimizing pattern modulation effects due to the rolling body of the munition/artillery shell 100.

In alternative embodiments two or more of the circularly-polarized edge slot antennas 200 may be implemented, each antenna 200 may implement multiple ground layers, such as three RF ground layers (208, 209 and 210) and may further implement multiple dielectric layers, such as two dielectric layers (202 and 204). Stacked, integrated multi-band antenna assemblies, such as dual band antenna assemblies 200 may be configured to share a common ground layer (ex—RF ground layer 209). Further, for multi-band antenna assemblies with more than two bands, a third dielectric layer may be included which shares a common ground layer with one of the first/second dielectric layers. Further, multiple frequencies may be supported by each antenna 200. For instance, each dual band antenna assembly 200 may support a first frequency (ex—L1) and a second frequency (ex—L2).

In current embodiments of the present invention, the antenna 200 may be fuse-mounted. In exemplary embodiments, the antenna 200 of the present invention may be implementable alone or in Proxy Fuse (Proximity Fuse) munition/artillery shell systems for fuse-tip/metal nose tip mount. For example, a GPS, multi-band circularly-polarized edge slot antenna 200 of the present invention may be implemented in an artillery shell/munition 100 with a Prox/C-band Prox/Proxy Fuse/Proximity Fuse/Proximity Communication System/Height of Burst Sensor (HOB) antenna, such that the GPS antenna(s) and the Prox Antenna(s) can be independent of one another within the fuse tip. In additional embodiments, the antenna 200 may be frequency scaled for providing a simplified direction guidance system for guiding an emitter signal into a null of the antenna's radiation pattern for a power detection based steering system, which may promote neutralization of jammer signal emitters in some CONOPS (Concept of Operations) scenarios.

Figure 4:
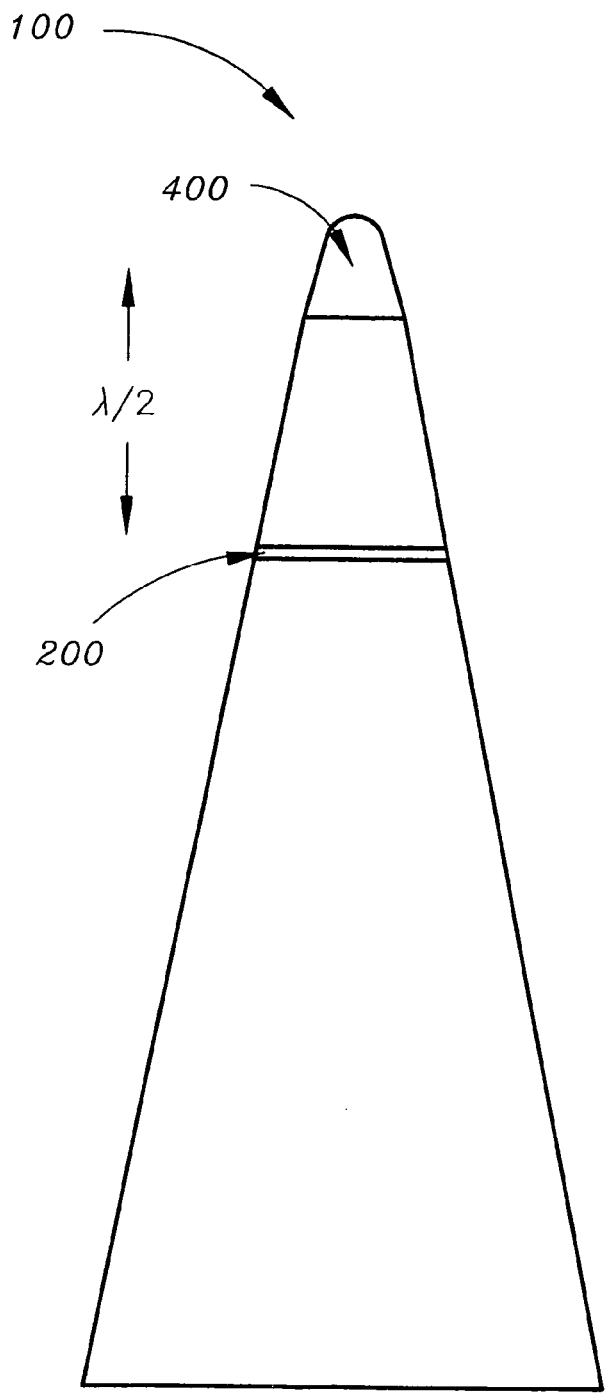
FIG. 4 is a view of an artillery shell implementing an antenna array which includes a circularly-polarized edge slot antenna and a dielectric resonator antenna in accordance with an exemplary embodiment of the present invention.

In exemplary embodiments of the present invention, the circularly-polarized edge slot antenna 200 may be implemented with a Dielectric Resonator Antenna (DRA), such as a Circularly-Polarized Dielectric Resonator Antenna (CP DRA) developed by Rockwell Collins, Inc. The circularly-polarized edge slot antenna 200 (CP ESA) and the CP DRA/DRA 400 are shown in FIG. 4 as being implemented/paired together as an antenna array in a munition/artillery shell 100. In exemplary embodiments, the DRA/CP DRA 400 may be a multi-band antenna which may be configured for supporting at least one of: L-band frequencies, S-band frequencies and C-band frequencies. The DRA 400 and the CP ESA 200 may exhibit very similar gain patterns and may be located a half-wavelength apart on a standard artillery shell fuse. These characteristics/conditions (ex.—maximizing separation between the nose-mounted antenna (DRA) and the secondary antenna (CP ESA)) may be necessary for providing optimal Anti-Jamming (AJ) performance. In current embodiments of the present invention, when the circularly-polarized edge slot antenna 200 is implemented with/paired with the nose-mounted DRA, it may enable on-shell Anti-Jamming (AJ) functionality for mortars and 155 millimeter North Atlantic Treaty Organization (NATO) shells.

Further, the circularly-polarized edge slot antenna 200 may be constructed of conventional microwave printed circuit materials which may allow said antenna to be sized/constructed so that it has fuse-compatible dimensions. In further embodiments, the antenna 200 may form/may be part of an antenna array which is electrically small (ex—the largest dimension of an antenna in the array is no more than one-tenth of a wavelength). In exemplary embodiments of the present invention, the circularly-polarized edge slot antenna 200 may have an on-axis phase center and may be a gun-hard, GPS antenna, which may be embedded within a munition/artillery shell 100 as described above. By being circularly-polarized, the edge slot antenna 200 may provide maximum gain. Further, by producing a forward-looking radiation pattern, the circularly-polarized edge slot antenna 200 may allow for minimum Time To First Fix (TTFF). Still further, the circularly-polarized edge slot antenna 200 may provide/may have a minimal footprint for spinning body artillery shell applications and may allow for minimal amplitude and phase ripple as a function of roll angle. The circularly-polarized edge slot antenna 200 may be implemented (either alone or in combination with the DRA 400) in GPS-guided munitions, such as: Precision Guidance Kit (PGK) systems (ex.—PGK II), Armored Gun Systems (AGS), PERM, Excalibur, etc.

Figure 5:
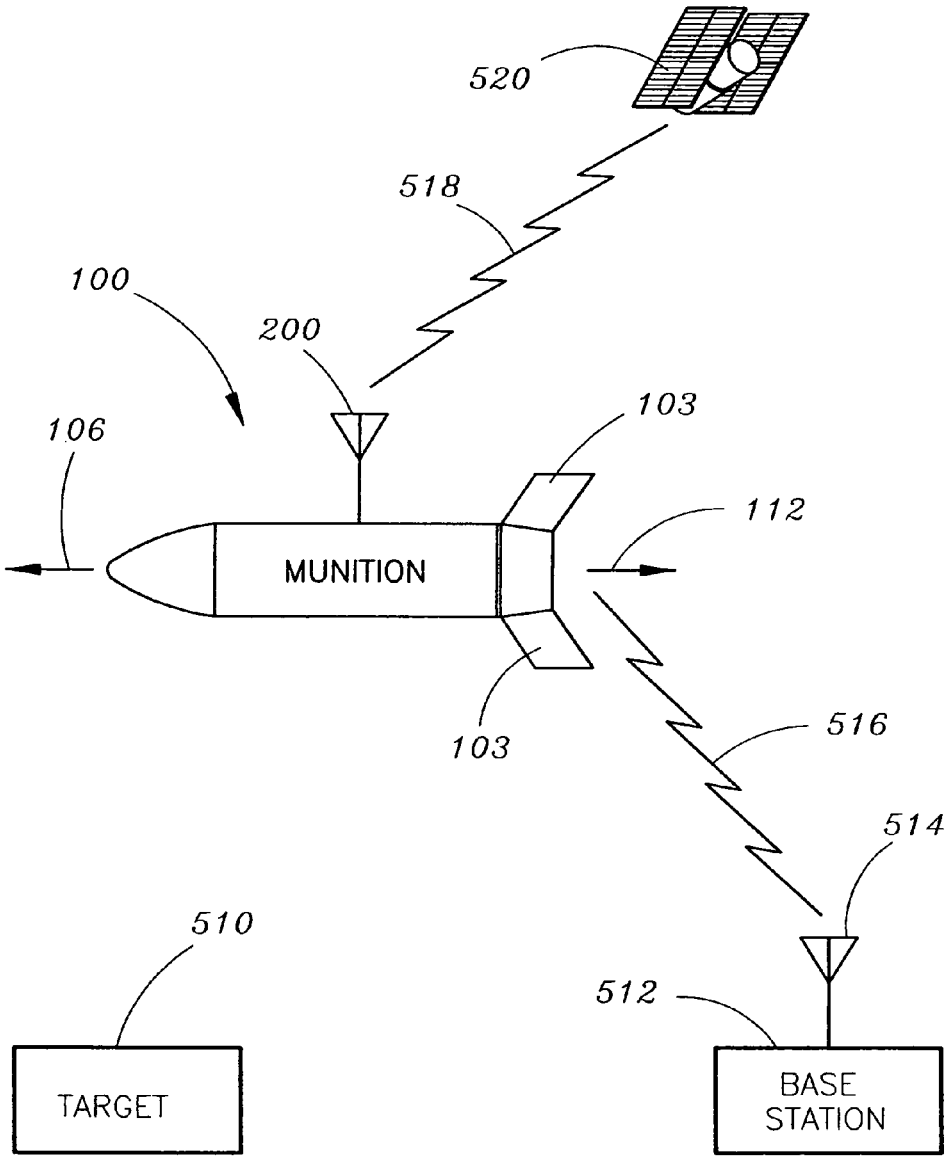
FIG. 5 is a communications schematic for an artillery shell/munition implementing a circularly-polarized edge slot antenna/circularly-polarized edge slot antenna array/antenna array of the present invention in accordance with an exemplary embodiment of the present invention.

Referring now to FIG. 5, there is shown a system of the present invention, which includes an artillery shell 100, which has been launched in a typical manner. The artillery shell 100 is moving in a forward direction 106 along a trajectory generally directed toward a target 510. The artillery shell has come from/originated from a rearward/aft direction 112 along the trajectory. In exemplary embodiments, it may be desirable to change the trajectory of the artillery shell 100, while said shell is in flight, in order to assure proper interaction with the target 510. In current embodiments of the present invention, the artillery shell 100 includes an on-board GPS receiver which continuously monitors the shell's position via a space directed signal 518 from satellite 520. The antenna/antenna array 200 may receive these GPS or other signals and may make course corrections either locally or via telemetry. Further, the antenna array may make other communications with a base station 512, through a terrestrial RF signal 516, and base station antenna 514. In additional embodiments, commands may be sent to the artillery shell 100 to deploy its retractable airfoil flaps 103, so as to change the aerodynamics, speed, and therefore, trajectory of the artillery shell 100. Still further, other signals, such as detonation commands for airborne detonation (of an explosive charge/payload of the shell), could be sent to the artillery shell 100 as well.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An artillery shell, comprising:

a payload;

a guidance system including a radio receiver; and a multi-element antenna array communicatively coupled to the radio receiver, the antenna array including a first antenna and a second antenna, wherein the first antenna is a circularly-polarized edge slot antenna and the second antenna is a dielectric resonator antenna.

2. An artillery shell as claimed in claim 1, wherein the circularly-polarized edge slot antenna is a multi-band antenna.

3. An artillery shell as claimed in claim 1, wherein the circularly-polarized edge slot antenna is configured for supporting at least one of: L-band frequencies, S-band frequencies and C-band frequencies.

4. An artillery shell as claimed in claim 1, wherein the circularly-polarized edge slot antenna is configured for supporting L1 and L2 frequencies.

5. An artillery shell as claimed in claim 1, wherein the antenna array is a Global Positioning System (GPS) antenna array.

6. An artillery shell as claimed in claim 1, wherein the circularly-polarized edge slot antenna is a fuse-mounted antenna.

7. An artillery shell as claimed in claim 1, wherein the circularly-polarized edge slot antenna has an on-axis phase center.

8. An artillery shell as claimed in claim 1, wherein the circularly-polarized edge slot antenna is embedded within the artillery shell.

9. An artillery shell as claimed in claim 1, wherein the circularly-polarized edge slot antenna is configured for providing a forward-looking radiation pattern.

10. An artillery shell as claimed in claim 1, wherein the circularly-polarized edge slot antenna is configured for being fed off-center via a plurality of offset probe feeds.

11. An artillery shell as claimed in claim 10, wherein the plurality of offset probe feeds are configured for driving a plurality of orthogonal modes in quadrature.

12. An artillery shell as claimed in claim 11, wherein the plurality of orthogonal modes are cavity modes formed within a dielectric region of the circularly-polarized edge slot antenna.

13. A multi-element anti-jamming (A/J) antenna array, comprising:

a circularly-polarized edge slot antenna; and a dielectric resonator antenna, wherein the circularly-polarized edge slot antenna and the dielectric resonator antenna are configured for implementation within at least one of an artillery shell and a munition.

14. A multi-element anti-jamming (A/J) antenna array as claimed in claim 13, wherein the antenna array is a Global Positioning System (GPS) antenna array.

15. A multi-element anti-jamming (A/J) antenna array as claimed in claim 13, wherein the circularly-polarized edge slot antenna has an on-axis phase center.

16. A multi-element anti-jamming (A/J) antenna array as claimed in claim 13, wherein the circularly-polarized edge slot antenna is configured for providing a forward-looking radiation pattern.

17. A multi-element anti-jamming (A/J) antenna array as claimed in claim 13, wherein the circularly-polarized edge slot antenna is configured for being fed off-center via a plurality of offset probe feeds.

18. A multi-element anti-jamming (A/J) antenna array as claimed in claim 17, wherein the plurality of offset probe feeds are configured for driving a plurality of orthogonal modes in quadrature.

19. A multi-element anti-jamming (A/J) antenna array as claimed in claim 18, wherein the plurality of orthogonal modes are cavity modes formed within a dielectric region of the circularly-polarized edge slot antenna.

20. An edge slot antenna, comprising:

a first dielectric substrate;

a second dielectric substrate; and a ground surface configured between the first substrate and the second substrate, said ground surface providing a boundary between the first substrate and the second substrate, wherein the edge slot antenna forms a first aperture for receiving a first feed and a second aperture for receiving a second feed, said feeds being offset feeds, the edge slot antenna being fed off-center via the first and second feeds for driving two orthogonal $TM_{110}$ cavity modes in quadrature within the dielectric substrates of the antenna, the $TM_{110}$ modes presenting fields to a radiation aperture of the antenna for causing the antenna to provide a forward-looking, circularly-polarized radiation pattern, the antenna having an on-axis phase center, said edge slot antenna being circularly-polarized and configured for implementation within at least one of an artillery shell and a munition.

* * * * *